US007928368B2

(12) United States Patent
Nissila et al.

(10) Patent No.: US 7,928,368 B2
(45) Date of Patent: Apr. 19, 2011

(54) MICROPILLAR ARRAY ELECTROSPRAY CHIP

(75) Inventors: Teemu Nissila, Helsinki (FI); Lauri Sainiemi, Espoo (FI); Raimo Ketola, Helsinki (FI); Samuli Franssila, Helsinki (FI); Risto Kostiainen, Helsinki (FI); Tapio Kotiaho, Helsinki (FI)

(73) Assignee: Licentia Oy, Helsinki (FI)

( * ) Notice: Subject to any disclaimer, the term of this patent is extended or adjusted under 35 U.S.C. 154(b) by 541 days.

(21) Appl. No.: 11/934,540

(22) Filed: Nov. 2, 2007

(65) Prior Publication Data

US 2009/0114814 A1 May 7, 2009

(51) Int. Cl.
*H01J 49/10* (2006.01)

(52) U.S. Cl. ..... 250/288; 250/281; 250/282; 250/423 R; 315/111.81

(58) Field of Classification Search ..... 250/288, 250/423 R, 281, 282; 315/111.81
See application file for complete search history.

(56) References Cited

U.S. PATENT DOCUMENTS

| | | | | |
|---|---|---|---|---|
| 5,969,353 | A * | 10/1999 | Hsieh | 250/288 |
| 2006/0113463 | A1 * | 6/2006 | Rossier et al. | 250/288 |
| 2007/0145263 | A1 * | 6/2007 | Weng | 250/288 |

FOREIGN PATENT DOCUMENTS

WO 03/103835 A1 12/2003

OTHER PUBLICATIONS

Sainiemi, et al ("Fabrication and fluidic characterization of silicon micropillar array electrospray ionization chip" Sensors and Actuators B: Chemical, vol. 132, issue 2, pp. 380-387, available online Oct. 2, 2007 according to ScienceDirect).*

Zimmermann, et al ("Capillary pumps for autonomous capillary systems" Lab Chip, 2007, pp. 119-125, vol. 7; first published as an Advance Article on the web on Oct. 17, 2006).*

"uTAS2006_Poster"—Nov. 5-9, 2006,Tokyo, Japan.

ASMS_poster_Jun. 3-7, 2007, Indianapolis, Indiana, USA.

"uPESI Transducers 2007 Poster Sainiemi"—Jun. 10-14, 2007, Lyon, France.

Helene Andersson, "Hydrophobic valves of plasma deposited octafluorocyclobutane in DRIE channels", Sensors and Actuators B, 2001, pp. 136-141, vol. 75.

Steve Arscott et al., "A nanofluidic emitter tip obtained by focused ion beam nanofabrication", Nanotechnology, 2005, pp. 2295-2302, vol. 16.

Steve Arscott et al., "A polysilicon nanoelectrospray-mass spectrometry source based on a microfluidic capillary slot", Sensors and Actuators B, 2005, pp. 741-749, vol. 106.

Steve Arscott et al., "Electrospraying from nanofluidic capillary slot", Applied Physics Letters, 2005, p. 134101, vol. 87.

(Continued)

*Primary Examiner* — David A Vanore
*Assistant Examiner* — Michael Maskell
(74) *Attorney, Agent, or Firm* — Sughrue Mion, PLLC

(57) ABSTRACT

The invention relates to an electrospray ionization (ESI) device for forming a stream of ionized sample molecules. The device comprises a sample introduction zone for receiving a liquid-form sample, a tip for spraying the sample into aerosol or gaseous form, and a flow channel connecting the sample introduction zone and the tip. According to the invention, the flow channel comprises an array of transversely oriented microstructures adapted to passively transport the liquid-form sample introduced to the sample introduction zone to the tip by means of capillary forces. The invention concerns also a manufacturing method and applications of the ESI device, in particular mass spectrometry. The device can be used without external pumping of sample liquid.

17 Claims, 10 Drawing Sheets

OTHER PUBLICATIONS

Olgica Bakajin et al., "Separation of 100-Kilobase DNA Molecules in 10 Seconds", Anal. Chem., 2001, pp. 6053-6056, vol. 73.
M. Brinkmann et al., "Microfluidic design rules for capillary slot-based electrospray sources", Applied Physics Letters, Sep. 13, 2004, p. 2140, vol. 85, No. 11.
Chi-Han Chiou et al., "Micro devices integrated with microchannels and electrospray nozzles using PDMS casting techniques", Sensors and Actuators B, 2002, pp. 280-286, vol. 86.
Reges Cezar de Andrade Costa et al., "Microfabricated porous glass channels for electrokinetic separation devices", Lab Chip, 2005, pp. 1310-1314, vol. 5.
Meint J. de Boer et al., "Guidelines for Etching Silicon MEMS Structures Using Fluorine High-Density Plasmas at Cryogenic Temperatures", Journal of Microelectromechanical Systems, Aug. 2002, vol. 11, No. 4.
Wim De Malsche et al., "Pressure-Driven Reverse-Phase Liquid Chromatography Separations in Ordered Nonporous Pillar Array Columns", Anal. Chem., 2007, pp. 5915-5926, vol. 79.
J. De Smet et al., "On the 3-dimensional effects in etched chips for high performance liquid chromatography-separations", Journal of Chromatography, 2007, pp. 189-197, vol. 1154.
Emmanuel Delamarche et al., "Microfluidic Networks for Chemical Patterning of Substrates: Design and Application to Bioassays", J. Am. Chem. Soc., 1998, pp. 500-508, vol. 120.
Weiwei Deng et al., "Increase of electrospray throughput using multiplexed microfabricated sources for the scalable generation of monodisperse droplets", Aerosol Science, 2006, pp. 696-714, vol. 37.
Amish Desai et al., "A MEMS Electrospray Nozzle for Mass Spectroscopy", International Conference on Solid-State Sensors and Actuators, IEEE, 1997, pp. 927-930.
Jean-Marie Dethy et al., "Demonstration of Direct Bioanalysis of Drugs in Plasma Using Nanoelectrospray Infusion from a Silicon Chip Coupled with Tandem Mass Spectrometry", Anal. Chem., 2003, pp. 805-811, vol. 75.
Frantisek Foret et al., "Microfluidics for Multiplexed MS analysis", Electrophoresis, 2006, pp. 4877-4487, vol. 27.
K. Grigoras et al., "Application of ultra-thin aluminum oxide etch mask made by atomic layer deposition technique", Journal of Physics: Conference Series, 2007, pp. 369-373, vol. 61.
Bing He et al., "Fabrication of Nanocolumns for Liquid Chromatography", Anal. Chem., 1998, pp. 3790-3797, vol. 70.
K. Huikko et al., "Poly(dimethylsiloxane) electrospray devices fabricated with diamond-like carbon-poly (dimethylsiloxane) coated SU-8 masters", Lab Chip, 2003, pp. 67-72, vol. 3.
Iulia M. Lazar et al., "Microfabricated Devices: A New Sample Introduction Approach to Mass Spectrometry", Mass Spectrometry Reviews, 2006, pp. 573-594, vol. 25.
Alexander Muck et al., "Atmospheric molded poly(methylmethacrylate) microchip emitters for sheathless electrospray", Rapid Communications in Mass Spectrometry, 2004, pp. 1459-1464, vol. 18.
Teemu Nissila et al., "Silicon micropillar array electrospray chip for drug and biomolecule analysis", Rapid Communications in Mass Spectrometry, 2007, pp. 3677-3682, vol. 21.
Nicholas J. Panaro et al., "Micropillar array chip for integrated white blood cell isolation and PCR", Biomolecular Engineering, 2005, pp. 157-162, vol. 21.
R.S. Ramsey et al., "Generating Electrospray from Microchip Devices Using Electroosmotic Pumping", Anal. Chem. 1997, pp. 1174-1178, vol. 69.
Fred E. Regnier, "Microfabricated Monolith Columns for Liquid Chromatography", J. High Resol. Chromatogr. 2000, pp. 19-26, vol. 23.
Lauri Sainiemi et al., "Fabrication and fluidic characterization of silicon micropillar array electrospray ionization chip", Sensors and Actuators B, 2007.
Benjamin E. Slentz et al., "Geometric effects of collocated monolithic support structures on separation performance in microfabricated systems", J. Sep. Sci. 2002, pp. 1011-1018, vol. 25.
Wang-Chou Sung et al., "Chip-based microfluidic devices coupled with electrospray ionization-mass spectrometry", Electrophoresis, 2005, pp. 1783-1791, vol. 26.
Santeri Tuomikoski et al., "Fabrication of enclosed SU-8 tips for electrospray ionization-mass spectrometry", Electrophoresis, 2005, pp. 3691-4702, vol. 26.
Nico Vervoort et al., "Importance and Reduction of the Sidewall-Inducted Band-Broadening Effect in Pressure-Driven Microfabricated Columns", Anal. Chem., 2004, pp. 4501-4507, vol. 76.
Xuan-Qi Wang et al., "Polmer-Based Electrospray Chips for Mass Spectrometry", IEEE, 1999, pp. 523-528.
Qifeng Xue et al., "Multichannel Microchip Electrospray Mass Spectrometry", Anal. Chem., 1997, pp. 426-430, vol. 69, No. 3.
Sheng Zhang et al., Automated chip-based nanoelectrospray-mass spectrometry for rapid identification of proteins separated by two-dimensional gel electrophoresis, Electrophoresis, 2003, pp. 3620-3632, vol. 24.
Martin Zimmermann et al., "Capillary pumps for autonomous capillary systems", Lab on a Chip, 2007, pp. 119-125, vol. 7.
Sainiemi et al., "Spontaneous microflow of micropillar array electrospray ionization microchip", Spontaneous flow micropillar electrospray chip, NanoTech 2006, Montreaux, Switzerland, Nov. 14-16, 2006.
Nissila et al., "Silicon micropillar array electrospray chip for drug and biomolecule analysis", Rapid Communications in Mass Spectrometry, vol. 22, pp. 3677-3682, published online Aug. 24, 2007.

* cited by examiner

MICROPILLAR ARRAY ELECTROSPRAY CHIP

BACKGROUND OF THE INVENTION

1. Field of the Invention

The invention relates to electrospray ionization. In particular, the invention relates to devices used for achieving a microfluidic sample stream which can be broken into droplets, ionized and sprayed, for example, for the purposes of mass spectrometry. The invention concerns also a method of manufacturing an electrospray device of the present kind and a method for performing mass-spectrometric analyses.

2. Related Art

Electrospray ionization (hereinafter also abbreviated as "ESI") is a technique used in mass spectrometry to produce ions. In conventional electrospray ionization, a liquid is pushed through a very small charged capillary. This liquid contains the analyte to be studied dissolved in a large amount of solvent, which is usually more volatile than the analyte. In ESI, the analyte is typically dissolved in a polar solvent, for example methanol, and is introduced into a mass spectrometer through a thin needle-shaped capillary tube. When the capillary is exposed to high voltage (2-5 kV), a strong electrostatic field is formed at the tip of the capillary and, as a result, a charged aerosol is formed in the gaseous phase from the solution coming out of the capillary. The charged droplets of the aerosol emit gaseous-phase ions into the gaseous phase. The ions are collected into a mass analyser of a mass spectrometer.

Mass spectrometry is used in many fields of science, such as pharmaceutical research, life sciences, and food and environmental analysis. In mass spectrometry (hereinafter also abbreviated as "MS") material is examined on the basis of data about its mass, and with MS it is possible, among other things, to identify the compounds of a chemical sample and to determine their quantity ($<10^{-11}$ M) in very low concentrations, from complex sample matrices. In ESI-MS gas-phase ions is generated as described above and the ions are separated on the basis of their mass/charge ratio (m/z) using electric and/or magnetic fields (mass analyser). The gas-phase ions are observed using a detector. The spectrum of the mass is established from a graph of the strength of the ionic current, which is generated by the detector, as a function of the m/z value of the ion. ESI is suitable for examining even large molecules (MW>100 kDa).

The current trend in analytical chemistry during recent years has been the miniaturization of analytical devices, using microfabrication technology. The goal is to integrate different miniaturized components on a lab-on-a-chip device, allowing faster and cheaper analyses with smaller amounts of sample than with conventional analytical devices. The common means of transferring liquids in microchannels of lab-on-a-chip devices are electroosmosis or pressure-driven flows. The drawback with both of these techniques is that an additional device, such as a pump or a high-voltage supply, is needed.

Miniaturized ESI solutions are already known, where flow channels for the sample solution and an injection tip used for ionising are machined in a monolithic, small glass plate, for example. Hereinafter, these devices are also called "ESI micro chips" or "μESI devices". Early developments of this kind of technology are described in U.S. Pat. Nos. 6,481,648 and 6,245,227.

Of more recent publications relating to ESI technology, US 2002/0139751 is mentioned. The device disclosed in the publication comprises a chip having a channel fabricated through a silicon wafer and extending from the tip of the chip to containers manufactured on the other side of the chip. JP 2005/134168, WO 2007/092227 and WO 2006/049333 disclose ESI devices comprising hollow channels, which are filled with porous material. US 2005/0116163 discloses an ESI needle comprising a channel, which may have a twisted or wavy inner geometry. JP 2005/190767 discloses an ESI nozzle made from metal-coated glass. Wire material may be included in the nozzle for aiding sample transfer. U.S. Pat. No. 6,297,499 discloses an ESI device, wherein the sample is conveyed to the spraying region using wicks. US 2002/0000507 discloses an electrospray device comprising a silicon substrate having a through-fabricated channel and an injection zone on the other surface of the substrate. The devices referred to above basically require pumping for sample transfer or high sample flow rates, or are prone to clogging.

Several other microchip based electrospray tips have also been developed during last few years as shown in recent scientific reviews by Lazar et al (I. Lazar, J. Grym, F. Foret, *Mass Spectrom. Rev.* 2006, 25, 573-594) and Sung et al (W-C. Sung, H. Makamba, S-H. Chen, *Electrophoresis* 2005, 26, 1783-1791). Shortly, these electrospray tips are made of either glass or polymers such as PDMS (polydimethylsiloxane), PMMA (polymethyl methacrylate) or SU-8, and they are based on off-chip spraying microdevices, in which a ESI capillary is separately attached to a microchip or on on-chip spraying microdevices, where the ESI tip is an integral part of a microchip. In these ESI microchips the liquid flow is generated either by means of pumps or electroosmosis.

Brinkmann et al (M. Brinkmann, R. Blossey, S. Arscott, C. Druon, P. Tabourier, S. Le Gac, C. Rolando, Appl. Phys. Lett. 2004, 85, 2140-2142) and Arscott and Troadec (S. Arscott, D. Troadec, A nanofluidic emitter tip obtained by focused ion beam nanofabrication, Nanotechnology 16 (2005) 2295-2302) have utilized capillary forces in a rectangular capillary slot for liquid transport from a reservoir to a cantilever ESI tip made from SU-8 and polycrystalline silicon (polysilicon). In addition to in-plane tips there are also silicon ESI tips with out-of-plane design (W. Deng et al./Aerosol Science 2006, 37, 696-714 and S. Zhang, C. K. van Pelt, J. D. Henion, Electrophoresis 2003, 24, 3620-3632).

The most popular fabrication materials of ESI chips have been glass (Q. Xue, F. Foret, Y. M. Dunayevskiy, P. M. Zavracky, N. E. McGruer, B. L. Karger, Multichannel microchip electrospray mass spectrometry, Anal. Chem. 69 (1997) 426-430 and R. S. Ramsey, J. M. Ramsey, Generating electrospray from microchip devices using electroosmotic pumping, Anal. Chem. 69 (1997) 1174-1178) and polymers, such as parylene (X.-Q. Wang, A. Desai, Y.-C. Tai, L. Licklider, T. D. Lee, Polymer-based electrospray chips for mass spectrometry, Tech. Digest, IEEE MEMS, Orlando, 1999 pp. 523-528), PDMS (H. Chiou, G.-B. Lee, H.-T. Hsu, P.-W. Chen, P.-C., Liao, Micro devices integrated with channels and electrospray nozzles using PDMS casting techniques, Sens. Actuators, B, Chem. 86 (2002) 1-7), and SU-8 (S. Tuomikoski, T. Sikanen, R. A. Ketola, R. Kostiainen, T. Kotiaho, S. Franssila, Fabrication of enclosed SU-8 tips for electrospray ionization-mass spectrometry, Electrophoresis 26 (2005) 4691-4702). However, these materials set limits to chip designs.

Silicon ESI chips (A. Desai, Y.-C. Tai, M. T. Davis, T. D. Lee, A MEMS electrospray nozzle for mass spectrometry", Tech. Digest, IEEE Transducers, Chicago, 1997, pp. 927-930 and S. Zhang, C. K. Van Pelt, J. D. Henion, Automated chip-based nanoelectrospray-mass spectrometry for rapid identification of proteins separated by two-dimensional gel electrophoresis, Electrophoreses 24 (2003) 3620-3632) have also been realized because of the well-explored microfabrication techniques of silicon. However, the conductivity of the silicon limits its use, because it excludes the use of electroosmotic flow in sample transport. Pressure driven flow has been the other popular method used for sample transportation in previous ESI chips. However, both of these methods require an external actuator, such as a high-voltage supply or a pump. Pressure driven flows also require the use of troublesome fluidic connectors. Some ESI chips exploit capillary forces to transport the sample, but narrow or closed channels are usually required in order to achieve sufficiently strong capillarity.

Despite recent developments in this field, there is still a constant demand for faster, easier-to-use, more selective, more sensitive and reliable analysis devices and methods especially for drugs and biomolecules using smaller sample volumes.

SUMMARY OF THE INVENTION

It is an aim of the invention to achieve a novel electrospray device and method, which overcomes at least some of the problems mentioned above. In particular, it is an aim of the invention to achieve an ESI microchip, which can be used without external pumping of sample liquid.

It is also an aim of the invention to achieve an effective electrospray device which is essentially non-clogging.

It is a further aim to achieve a novel device method for performing mass spectrometric analysis with an improved sensitivity to sample volume ratio.

An additional aim is to achieve a novel method for manufacturing an electrospray device having the abovementioned advantages.

The invention is based on the idea of providing to the flow channel of an electrospray device an array of microstructures, which allow for spontaneous transportation of the sample to the spraying tip of the device.

Thus, a device according to the invention comprises a sample introduction zone, a tip for spraying the sample introduced to the sample introduction zone, and a flow channel connecting the sample introduction zone and the tip. According to the invention, the flow channel comprises an array-like formation of microstructures, in particular micropillars, which, by means of capillary forces, transport the liquid introduced to the sample introduction zone to the tip. The flow channel typically has a substantially planar bottom and a dense set of microstructures in the form of protrusions extending in perpendicular manner from the bottom of the flow channel.

According to one embodiment, the device is manufactured on/into a planar monolithic substrate, the liquid transportation taking place in the plane of the substrate.

According to one embodiment, the microstructures are micropillars being substantially circular or elliptical in cross-section. According to a further embodiment, the micropillars are arranged in a regular formation, in which the cross-sectional diameter of the pillars is 1-80 μm and the center-to-center distance between neighboring pillars is 1-80 μm.

According one embodiment the flow channel is in the vicinity of the tip tapering towards the tip. The tip width can correspond to, for example, 1-5 micropillars, preferably 1-3 micropillars.

According to one embodiment, the device is fabricated on a semiconductor wafer, typically a silicon wafer, in particular by photolithographic techniques. According to one embodiment, the device is fabricated using ion etching techniques, in particular deep reactive ion etching (DRIE).

According to another embodiment, the device in manufactured from glass or polymer. With these substrates, both microengraving and molding into the desired form may be used.

According to one embodiment, also the sample introduction zone comprises an array of micropillars. Typically, the whole sample-conduction pathway from the sample introduction to the tip is equipped with a regular columniation of micropillars. According to one embodiment, the bottom of the flow channel lies in one plane. Also the bottom of the sample-introduction zone can lie in the same plane.

According to one embodiment, the device is open at the top, that is, lidless. This applies in particular to the sample introduction zone. That is, sample solution can be introduced to the device from above, that is, the open side. However, also the flow channel may be open.

According to an alternative embodiment, at least the flow channel portion of the device is covered by a lid in order to form a closed micropillar flow channel. The lid can be made, for example, from silicon, glass or polymer. Both open and closed flow channel designs are suitable for chromatographic separation. Equally, in both designs the detection stage can be carried out by ESI means integrated on the same chip.

According to one embodiment, the surface of the flow channel is physically or chemically modified in order to change its chromatographic selectivity, flow properties or both. According to one embodiment, the flow channel may comprise a coating of material having surface interaction properties with solutions to be analysed, in particular aqueous solutions, different from those of the substrate the flow channel is manufactured to. The coating can be applied by physical or chemical deposition or synthetization techniques known per se. The coating may comprise, for example, hydrophobic material, such as C18 (octadecyl), NH2 (aminopropyl), C8 (octyl) or silica or a mixture of thereof, for achieving a microstructured reversed phase flow channel. Also hydrophilic coatings may be employed.

According to one embodiment, the sample introduction zone (and, optionally also the flow channel) of the device is provided with material capable of taking part into or affecting chemical or biological reactions, such as reagents or enzymes or other biological material. By integrating such material to the ESI device, one can perform reactions on the chip and further conduct the reacted matter along the flow channel for electrospray ionization on-line. That is, the sample introduction zone serves as an on-chip reactor, whose functioning is easily analysable by using the device according to the present invention.

According to one embodiment, the width of the flow channel is 10 μm-3 mm, in particular 0.5-3 mm. The area of the sample introduction zone typically varies between 2 $mm^2$ and 10 $mm^2$ and may have a circular, elliptical, rectangular or triangular shape or any combination of these.

The depth of the flow channel, that is, the height of the micropillars, is typically 1-80 μm.

The micropillar ionization device shortly described above is hereinafter frequently called a μPESI (MicroPillar Electro-Spray Ionization) chip.

The invention offers significant advantages over prior art. We have found that the sensitivity of mass spectrometric analyses using the present electrospray tip is high, similar to or better than that achieved with nanospray or other microfluidic chips due to very stable ionization and spraying characteristics. The open micropillar system makes μPESI very easy to use without pumps or high-voltage supplies, that is completely passively or spontaneously. μPESI provides reliable and quantitative long-term analysis with no clogging problems. The filling of the chip with liquid is reliable.

The same microchip can be easily used for several consecutive samples by flushing the chip with a solvent between the analyses. These are important advantages over the currently used nanospray needles, in which the introduction of a sample into the needle may be cumbersome and only a single sample can be analyzed with each needle.

Furthermore, as shortly described above, the present chip design makes it possible to integrate a microreactor into the system, e.g. for on-line enzymatic reaction monitoring by immobilizing enzymes, microsomes or other biological material on the pillar array. For all these reasons μPESI/MS is a promising new method for bioanalysis, e.g. in proteomics and metabolomics as well as for analysis of small molecules.

In particular, a silicon-based ESI chip with an array of micropillars and a sharpened ESI tip has been found to be advantageous. The microfabrication of silicon chips is straightforward providing very accurate and reproducible chip production. The chips are relatively cheap to fabricate and are suitable for disposable use. Silicon as fabrication material gives more freedom to chip design than other materials. Therefore, a truly three-dimensional in-plane ESI tip and a flow channel filled with an array of perfectly ordered high aspect ratio micropillars can be fabricated.

Silicon is the preferred starting material for the present ESI chip, because glass microfabrication techniques are cumbersome compared to silicon micromachining and through-wafer processing is relatively inaccurate. On the other hand, polymer microfabrication is generally easy and fast, but at the moment it does not enable fabrication of robust high aspect ratio structures and complex three-dimensional features like silicon does. However, generally speaking, also these materials are within the scope of the invention.

The application of the sample onto the μPESI chip is easy because it can be lidless. The sample transport from the sample introduction spot to the ESI tip of the chip is spontaneous because of the capillary forces facilitated by the micropillar array. This filling method circumvents the use of pumps and cumbersome fluidic connectors. The micropillar array inside the channel is shown to have an essential role in the sample transport. Without the microarray wide lidless channels cannot be filled without external pumping.

The μPESI chip also offers particularly sensitive and stable analysis when coupled to a mass spectrometer. This combination of ease of use and high sensitivity is expected to be very useful in analysis of both small drug molecules as well as biomolecules.

As an example, the limit of detection for verapamil measured with MS/MS was 30 pmol/l. The system showed also quantitative linearity ($r^2$=0.997) with linear dynamic range of at least six orders of magnitude and good stability (standard deviation<4%) at a measurement lasting for 60 minutes.

Next, the embodiments of the invention will be discussed in more detail with reference to the attached drawings.

DETAILED DESCRIPTION OF THE INVENTION

Figure 1A:
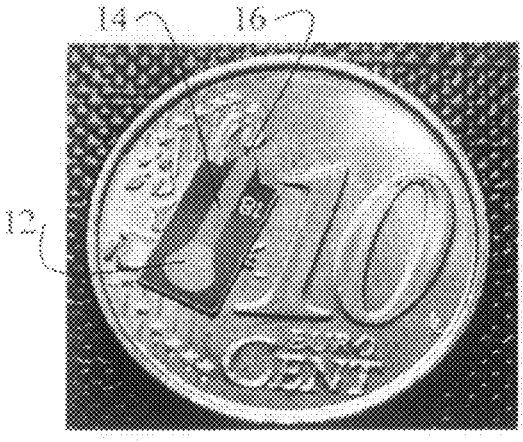
FIGS. 1A and 1B are photographs of μPESI chips on 10-euro-cent and 20-euro-cent coins.
Figure 1B:
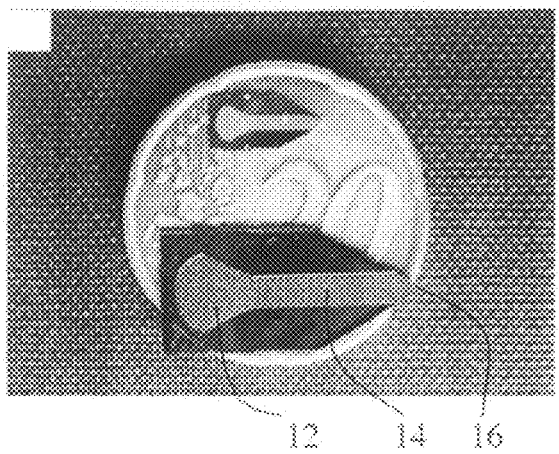
Figure 2A:
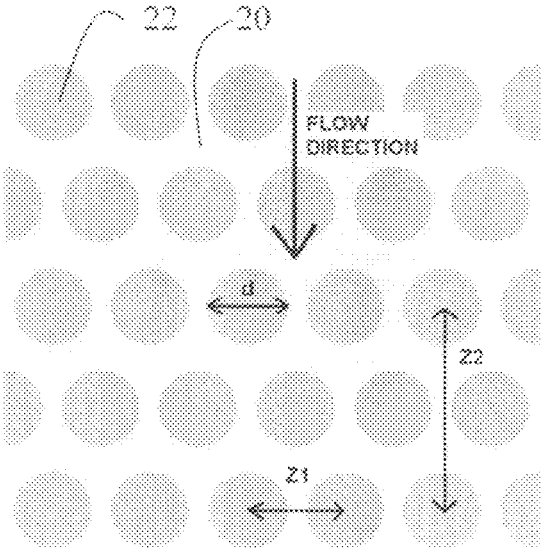
FIG. 2A shows in a cross-sectional view packing of the pillars inside the flow channel.

In this section, a silicon electrospray ionization chip for the mass spectrometric analysis is described, along with its fabrication method and characteristics. With reference to FIG. 1, the chip has three parts: a sample introduction spot 12, a flow channel 14, and a sharp electrospray ionization tip 14. A regular micropillar array, shown in FIGS. 2A and 2A, is micromachined inside the whole channel. As can be seen, the chip has no lid, which makes the sample application easy.

With reference to FIG. 2A, according to one embodiment, the chip comprises a flow channel 20, where capillary forces are facilitated by micropillars 22 arranged in rows shifted in one dimension in turns. No external pumping is required and the only high voltage source needed is the one necessitated by MS. The whole chip can be made out of silicon, which allows the fabrication of high aspect ratio micropillars 22 inside the channel 20 and the accurate definition of a truly three-dimensional, in-plane tip, as shown below. The tip and the flow channel can be in-plane and the tip can be manufactured sharp so as to provide un-aided spraying. The chip combines self-filling of the channel, based on capillary forces of the micropillar array, and electrospray ionization at the tip of the chip.

Figure 2B:
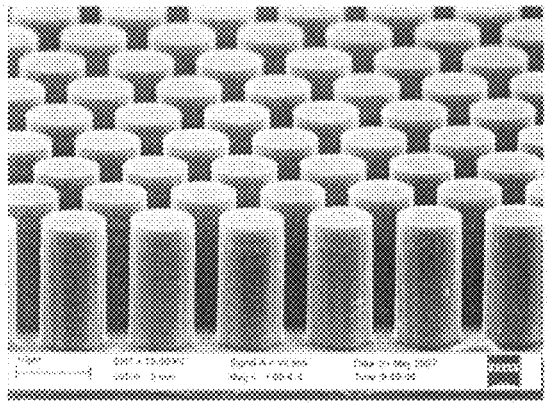
FIG. 2B is a perspective view of the structure of FIG. 2A.

With reference to FIG. 2A, the pillar diameter d can, for example, vary within the range of 1-200 μm, in particular 1-80 μm and the pillar centre-to-centre distances Z1 and Z2 are typically of the order of 1-250 μm, in particular 1-80 μm, and 11-500 μm, in particular 1-160, respectively. Z1 is the distance between neighboring micropillars and Z2 is the distance between second-nearest micropillars. Several working examples have been manufactured and tested, from which a first conforming to the design parameters d=10 μm, Z1=12 μm and Z2=22 μm (as shown in FIG. 2B), and a second conforming to the design parameters having d=60 μm, Z1=75 μm and Z2=160 μm are mentioned. It has been proven than both these sets of geometrical parameters provide reliable capillary filling, even at relatively high contact angles (see below under the subtitle "Capillary Filling").

The hexagonal pillar geometry described in detail above and illustrated in the drawings represents only one possible option. It has to be understood that a similar liquid-transporting effect may be achieved by other regular and non-regular arrays provided that the density of the array allows for capillary transportation of liquid.

Fabrication

According to one embodiment, the fabrication process utilizes nested masks of silicon dioxide and aluminum oxide. In addition, a combination of anisotropic and isotropic plasma etching steps allows formation of a truly three-dimensional electrospray ionization tip without double-sided lithography.

The present microchips can be fabricated using deep reactive ion etching (DRIE) which results in accurate dimensional control. The chip provides a reliable open-channel filling structure based on capillary forces, which eliminates the use of pumps or high-voltage supplies for liquid transfer and offers very easy operation.

Fabrication Example 1

FIGS. 3A-3F show a μPESI chip comprising a sample introduction spot, a liquid transfer channel, and a sharp tip for direct ESI in different stages of an exemplary fabrication process. The bottom layer 30 is a silicon substrate (300 μm); the middle layer 32 is a $SiO_2$ (1020 nm) layer and the top layer 34 a $Al_2O_3$ (96 nm) layer. Photoresist layers are not shown in the figure.

The μPESI chips were fabricated on 300-μm thick <100> silicon wafers that had resistivity of 1-50 Ohm-cm. Both p and n-type wafers were used. The chip has a 2.5-mm wide circular sample introduction spot and a 5.5-mm long and 1-mm wide straight flow channel, which ends to a sharp, in-plane ESI tip. The chip has no lid. Both the sample introduction spot and the flow channel contain a perfectly ordered array of micropillars. Two different sets of geometrical parameters for pillars and pillar packing were used. Similar chips without the pillar array were also fabricated for reference. The depth of the channels was varied between 20 and 40 μm.

Figure 3A:
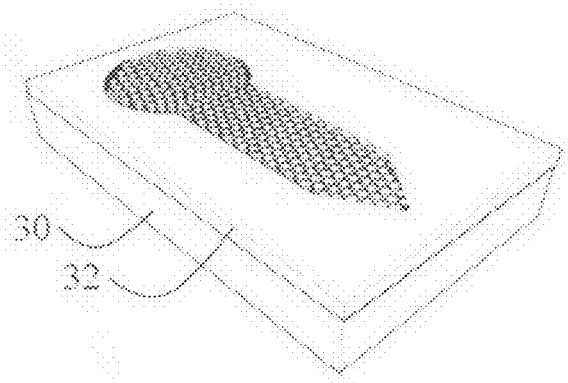
FIGS. 3A-3F illustrate the fabrication process of the μPESI chip (without sharpening process).
Figure 3B:
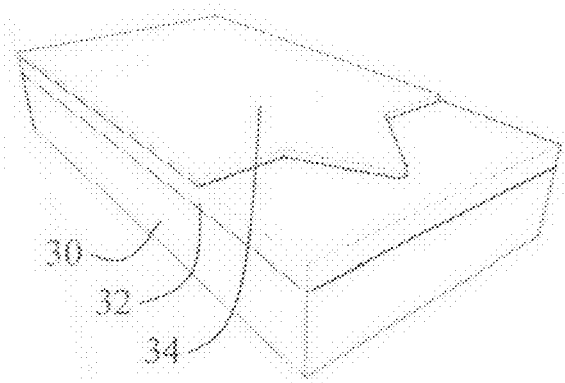
Figure 3C:
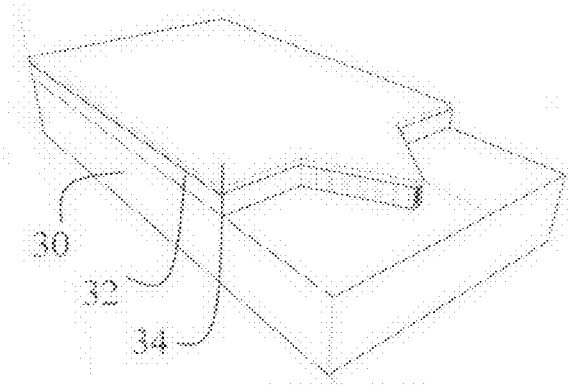
Figure 3D:
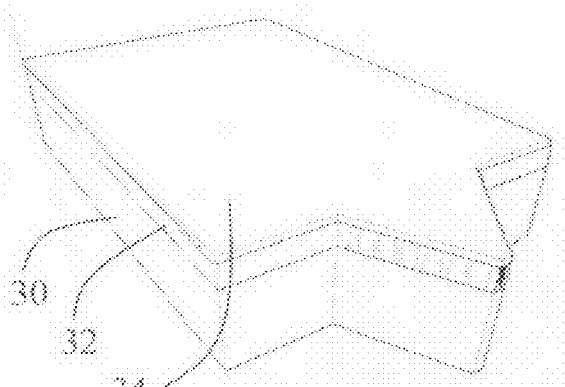
Figure 3E:
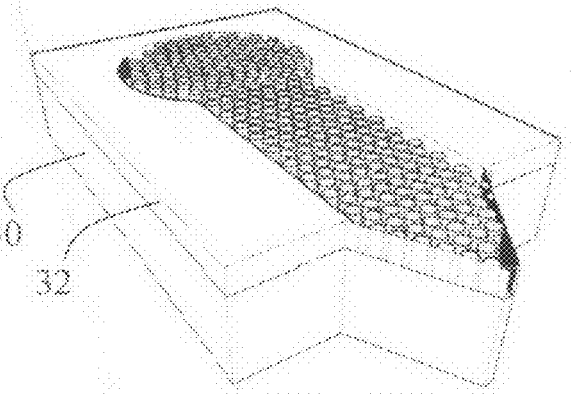

The fabrication process had two mask levels and utilized nested masks of silicon dioxide ($SiO_2$) and aluminum oxide ($Al_2O_3$), which were both patterned on the wafer prior to any silicon etching. First, $SiO_2$ was thermally grown on the wafers. The $SiO_2$ mask for pillar channels was etched by $CHF_3$/Ar reactive ion etching (RIE) using a photoresist mask (FIG. 3A). After photoresist removal, amorphous $Al_2O_3$ layer was deposited on top of the patterned $SiO_2$ mask using atomic layer deposition (ALD). The deposition took place at 220° C., trimethylaluminum and water vapor being the source gases. The second lithography defined the sharp ESI tip at the end of the flow channel. Both $Al_2O_3$ and $SiO_2$ were etched away from tip area, by phosphoric acid and $CHF_3$/Ar RIE, respectively (FIGS. 3B, 3C). Aluminum oxide served as an etch mask during the through-wafer deep reactive ion etching (DRIE) (FIG. 3D).

If a three-dimensionally sharp ESI tip is desired, the through-wafer etching can be done in two parts. First, fairly shallow anisotropic silicon DRIE step is performed. Then, a 250-nm thick $SiO_2$ passivation layer is deposited using plasma enhanced chemical vapor deposition (PECVD). Deposited PECVD $SiO_2$ is removed from horizontal surfaces using $CHF_3$/Ar RIE again, but vertical sidewalls remain passivated because of the anisotropic nature of the RIE step. The rest of the through-wafer etching is also done with DRIE, but using a more isotropic etching process. Isotropic etching causes undercutting and because of the passivation layer a three-dimensionally sharp tip is formed. The two-step anisotropic-isotropic sharpening process is not shown in FIG. 3.

Figure 3F:
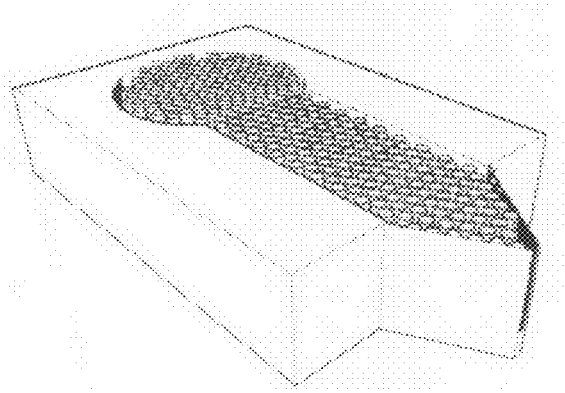

After the through-wafer etching, the $Al_2O_3$ mask was removed in phosphoric acid (FIG. 3E) and the pillar channels were created in another anisotropic silicon DRIE step, using the revealed $SiO_2$ pattern as a mask. All silicon etchings were done in inductively coupled $SF_6/O_2$ plasma at cryogenic temperature (Plasmalab System 100, Oxford Instruments, UK). After the last silicon DRIE step the remaining $SiO_2$ was removed using buffered hydrofluoric acid (FIG. 3F). The channels can be transformed to more hydrophilic using short oxygen plasma treatment or Piranha treatment.

Fabrication Example 2

μPESI chips comprising a sample introduction spot, a liquid transfer channel, and a sharp tip for direct ESI were fabricated on 380-μm-thick n-type <100> silicon wafers with resistivity of 1-14 Ω-cm and diameter of 100 mm. Deep reactive ion etching (DRIE) of silicon was done using Plasmalab System 100 reactor (Oxford Instruments, UK).

Figure 4:
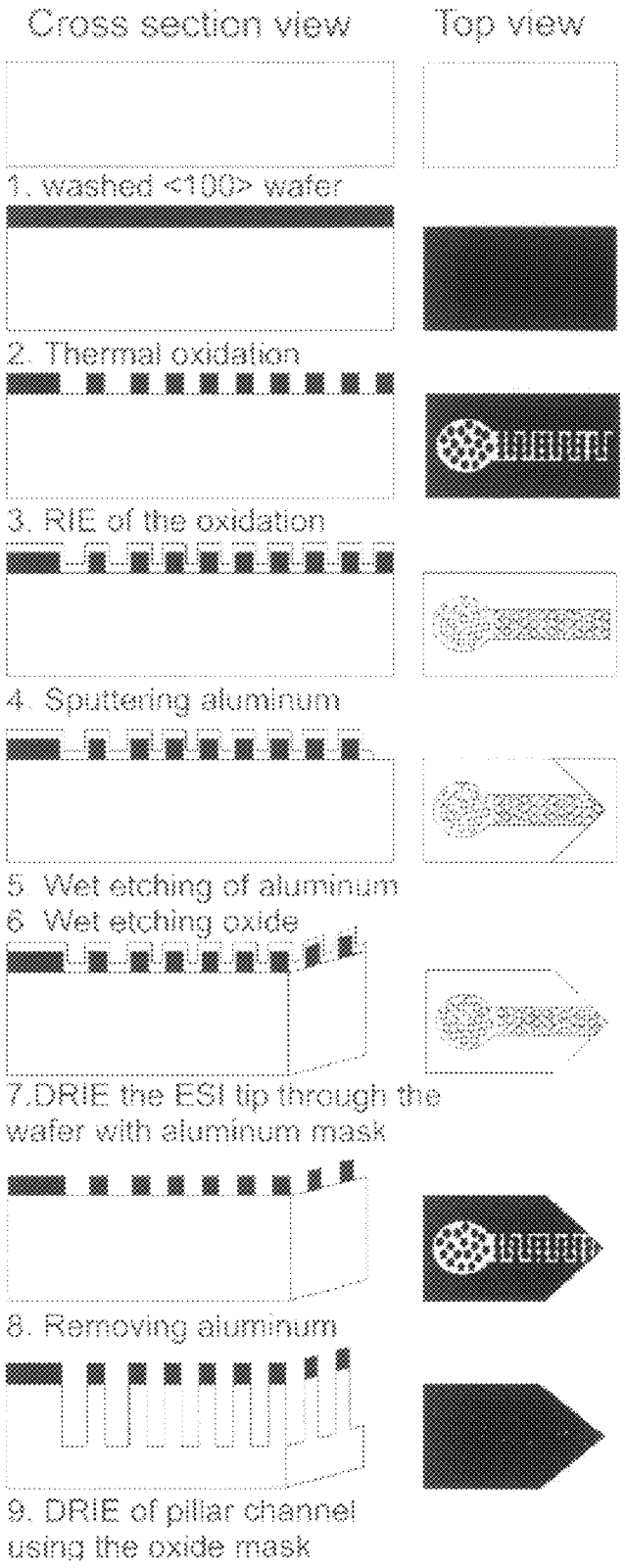
FIG. 4 shows in a schematic level the cross-sectional and top views of the chip design during fabrication.

The fabrication process is described in FIG. 4. Briefly, the two lithography-step fabrication process utilized nested masks of silicon dioxide ($SiO_2$) and aluminum (Al), which were both patterned on the wafer prior to any Si etching. $SiO_2$ and Al have shown to work well in deep reactive ion etching process at cryogenic temperatures. $SiO_2$ was thermally grown on the wafers (step 2). The patterns for the pillar channels were etched into the 520-nm-thick $SiO_2$ layer using RIE (step 3). The aluminum layer (200 nm) was sputtered on top of the $SiO_2$ structures (steps 4 & 5). The aluminum and $SiO_2$ were wet etched from the tip using a phosphoric acid based etchant and buffered hydrofluoric acid (BHF), respectively. Aluminum served as a mask during the through-wafer etching (step 7) which defined the sharp ESI tips at the ends of the channels. The angle at the tip was approximately 60 degrees. The Al mask was removed (step 8) and the 40-μm-deep pillars were etched in another Si etching step, using the previously made $SiO_2$ pattern as a mask (step 9). The both silicon DRIE steps were done in inductively coupled $SF_6/O_2$ plasma at cryogenic temperature. After silicon etching the remaining $SiO_2$ was removed in buffered hydrofluoric acid. Finally, the chips were diced using a wafer saw. Two different chip sizes were fabricated: the small chip had 8-mm-long and 1-mm-wide channels and the large chip 18-mm-long and 2.25-mm-wide channels. Pillar diameters ranged from 15 to 200 μm in different chips and the distances between the pillars varied from a micrometer to 80 μm. This fabrication procedure produced well-shaped, uniform micropillars with well-defined and accurate distances between them. Also the height of micropillars can be precisely defined, thus increasing the chip-to-chip reproducibility. The fabrication costs per one μPESI chip are low as over one hundred chips can be produced on one 100 mm diameter silicon wafer.

Characteristics of μPESI Chips and of the Fabrication Process

Figure 5A:
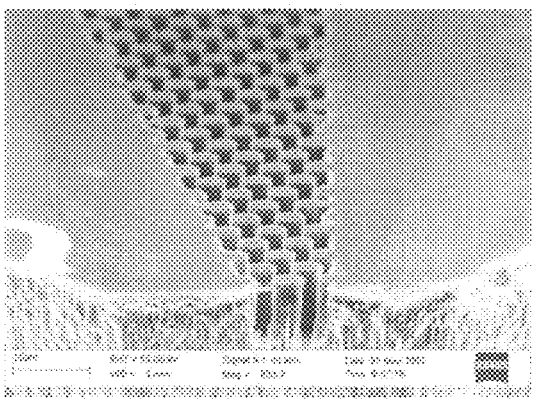
FIGS. 5A and 5B show in detail photographs of an ESI tip of the μPESI chip (fabricated without sharpening process).
Figure 5B:
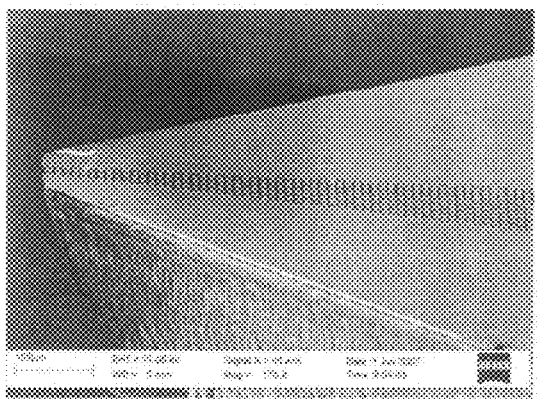

In ESI-MS a strong electric field at the tip of the ESI chip forms a Taylor cone and the liquid breaks into droplets that are ionized. The ionized molecules are analyzed using a MS. The voltage needed to create an electric field that is sufficiently strong for formation of electrospray is known to be dependent on the sharpness of the ESI tip. The sharper the tip, the lower the onset voltage of electrospraying is. Therefore, it is desirable to have a three-dimensionally sharp ESI tip. The ESI tip fabricated without the sharpening process is shown in FIGS. 5A and 5B. The width of the 100 μm wide ESI tip is defined by the second lithography step and therefore easily adjusted. The thickness control of the tip is not as easy, because it cannot be determined by lithography. The tip presented in FIGS. 5A and 5B has the thickness of 300 μm, which is determined by the wafer thickness.

Figure 6A:
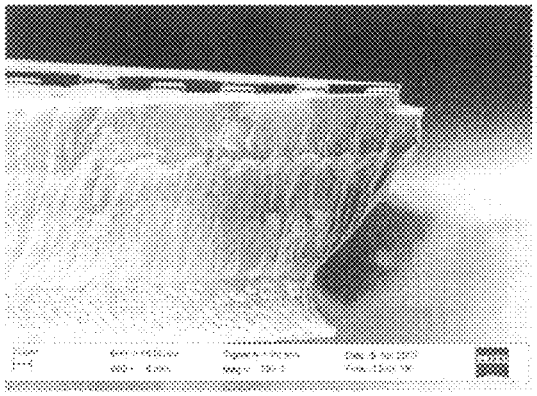
FIGS. 6A and 6B show in a cross-sectional and tilted top view an ESI tip of the μPESI chip (sharpening process utilized in through-wafer etching).
Figure 6B:
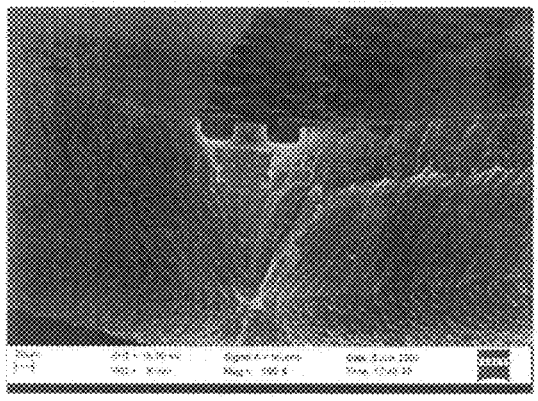
Figure 6C:
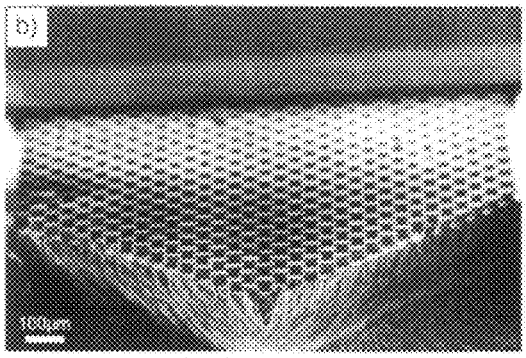
FIG. 6C shows another photograph of a sharpened ESI tip.

The thickness control of ESI tip without double-sided lithography requires adequate combination of anisotropic and isotropic plasma etching steps. Combining the sharpening process discussed above with a narrow tip results in a three-dimensionally sharp ESI tip. The shorter the first anisotropic etching step during the sharpening process is, the sharper the tip becomes. However, the depth of the first anisotropic etching during the sharpening process must always be greater than that of the pillar channel. The tradeoff of an extremely sharp tip is poorer mechanical strength. The ESI tip of the μPESI chip where sharpening process was utilized is presented in FIGS. 6A and 6B. Passivation layer protects the top part of the chip during isotropic etching.

We used ALD $Al_2O_3$ layer as a mask during the through wafer-etching process, because of its exceptionally high selectivity in cryogenic DRIE. Also the selective removal of $Al_2O_3$ after the through-wafer etching process is important. $Al_2O_3$ can be removed using phosphoric acid without affecting the underlying $SiO_2$ layer and silicon surface. Aluminum etch mask was also tested for the through wafer etching, but in fluorine based plasmas sputtering and redeposition of aluminum result in rough etched surfaces.

Capillary Filling

Capillary filling of microchannels is based on the surface energetics of the system. A liquid will fill a microchannel spontaneously if doing so leads to a decrease of the total surface free energy. The surface energies of the system and the contact angle are linked by the Young-Dupré equation:

$$\gamma_{sv}-\gamma_{sl}=\gamma_{lv}\cos\theta, \tag{1}$$

where θ is the contact angle, $\gamma_{lv}$, $\gamma_{sl}$, and $\gamma_{sv}$ are the surface energies of the liquid-vapor, solid-liquid and the solid-vapor phases respectively.

The capillary pressure in a microchannel with a rectangular cross section has been given as:

$$P=\gamma_{lv}\left(\frac{\cos\theta_t+\cos\theta_b}{d}+\frac{\cos\theta_l+\cos\theta_r}{w}\right), \tag{2}$$

where $\theta_t$, $\theta_b$, $\theta_l$, and $\theta_r$ are the contact angles at the top, bottom, left, and right channel walls respectively, d is the depth of the channel and w is the width of the channel. In the absence of other driving forces, a microchannel will fill spontaneously if the capillary pressure is positive. Other forces that are present in our experimental setup include forces generated by hydrostatic pressure and Laplace pressure of the droplet, but their contribution is usually small.

We investigated the filling properties of similar channels with and without a micropillar array. A 2.5-μl de-ionized water droplet was applied onto the sample introduction spot and capillary filling was observed under an optical microscope. Typical filling experiments are presented in FIGS. 7 and 8. Both channels were 22.5 μm deep and 1 mm wide. Contact angle of the etched silicon with de-ionized water was measured immediately after the experiment by sessile drop method (CAM 101 from KSV Instruments, Finland) and it was 47°±2°. The contact angle of the top wall was taken to be 180° since the material of the top wall was air.

Figure 7A:
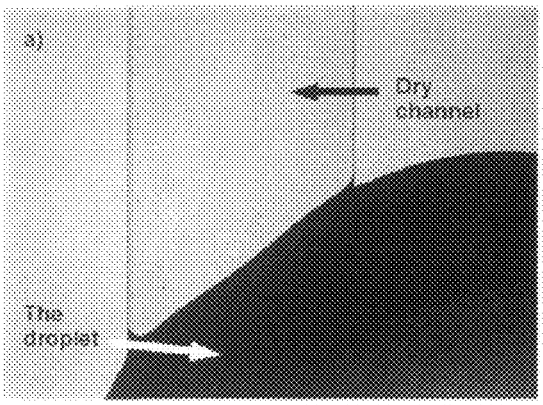
FIGS. 7A and 7B show a water droplet being applied onto the flow channel without micropillars at two time points.
Figure 7B:
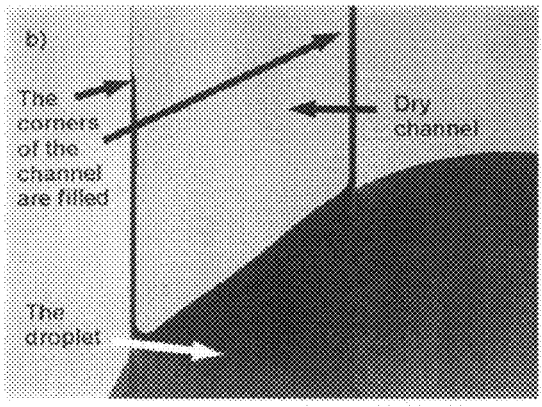

Inserting these values into Equation (2) gives approximately −930 Pa as the capillary pressure in the channels without pillars, which means that the channels should not fill spontaneously by capillarity. This is also what was observed in the experiments (FIGS. 7A and 7B). Instead, the channels filled only at the corners and even there the flow was very slow. Capillary flow in corners is well known and for a 90° corner, it should happen spontaneously when the contact angle is less than 45°. Since the measured contact angle was slightly higher than this, it is possible that in this experiment the vertical sidewalls were slightly more hydrophilic than horizontal areas.

Figure 8A:
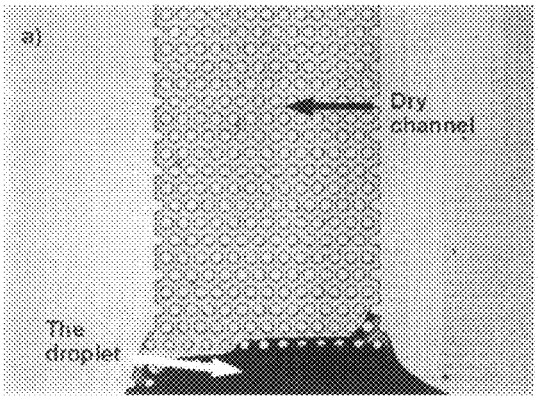
FIGS. 8A and 8B show a water droplet being applied to a micropillar channel at two time points.
Figure 8B:
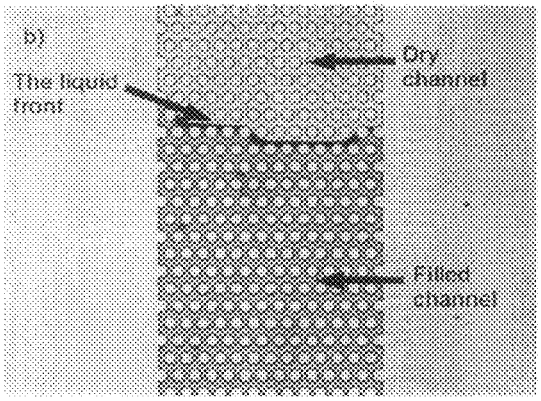

The channels with a micropillar array filled spontaneously as shown in FIGS. 8A and 8B. That is, the micropillars facilitate the capillary forces and the whole channel is filled without other driving forces. The sidewalls of the pillar channel were most conductive to capillary flow and the flow often proceeded to a new pillar row first at the edgemost pillar and then filled rest of the row. Qualitatively, the difference in capillary properties of a channel with and without a micropillar array is that the channel with the pillar array has a lot more hydrophilic surface area per unit length, which makes the pillar channels much more conductive to capillary flow.

Contact angles in the 45°-50° range started to be near the limit of capillary filling even for the both pillar channel geometries tested (See description of FIG. 2A above). At these contact angles the filling was very slow (approximately 1 mm/min) and the sample spot droplet evaporated before the entire channel had filled. At more hydrophilic contact angles, in the 20°-35° range, the both pillar channels filled quickly (approximately 1 mm/s) and the channels without pillars still filled only at the edges. At extremely low contact angles (<10°), capillary pressure (2) becomes positive even for the channels without micropillars and the droplet quickly wetted even the channels without pillars. Both pillar channel geometries used produced similar flow rates, but in general the geometrical parameters of the pillar channel also affect filling rate.

Wide pillar channels are preferred in comparison to narrow channels without pillars because of the increased sample capacity and low clogging probability. The wide pillar channels provide sufficient volume for sample, and therefore sample supply to the ESI tip is continuous, which is essential for stable electrospraying. The clogging of the pillar channel is highly improbable because the sample flow is not stopped if one or even a few gaps between pillars are blocked.

Experiments

In a first stage, the operation of the present μPESI chip was explored by mass spectrometric measurements by coupling the chip to a mass spectrometer (Applied Biosystems/MDS Sciex API-3000, Concord, Ontario, Canada) and tested for the detection of drug molecules. The sample volume applied onto the sample introduction spot was varied between 0.5 and 4.0 μl. The application of the sample onto the chip is extremely easy because the chip is lidless. The sample was driven through the flow channel by capillary forces. When the sample reached the ESI tip of the chip it was sprayed out forming a Taylor cone in the electrospray ionization process. No auxiliary gas or liquid flow was required to produce stable spraying. The voltage needed for ionization depended on the distance between the chip and the first lens of MS. When the distance was 1.5-2.0 cm, the voltage needed was 4.0-4.5 kV, while the first lens of MS was kept at the potential of 1 kV.

Figure 9:
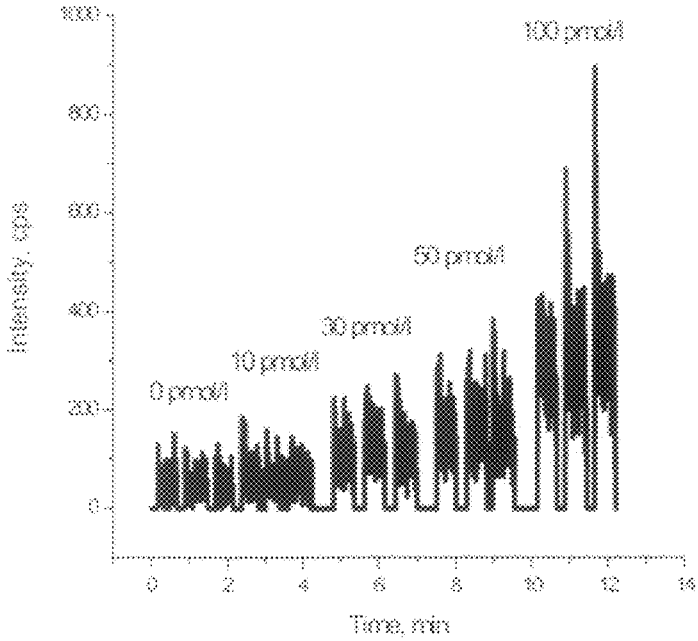
FIG. 9 illustrates the sensitivity of the measurement using the μPESI chip. A blank sample and four different concentrations of verapamil (each injection 2.5 μl) were measured.
Figure 10:
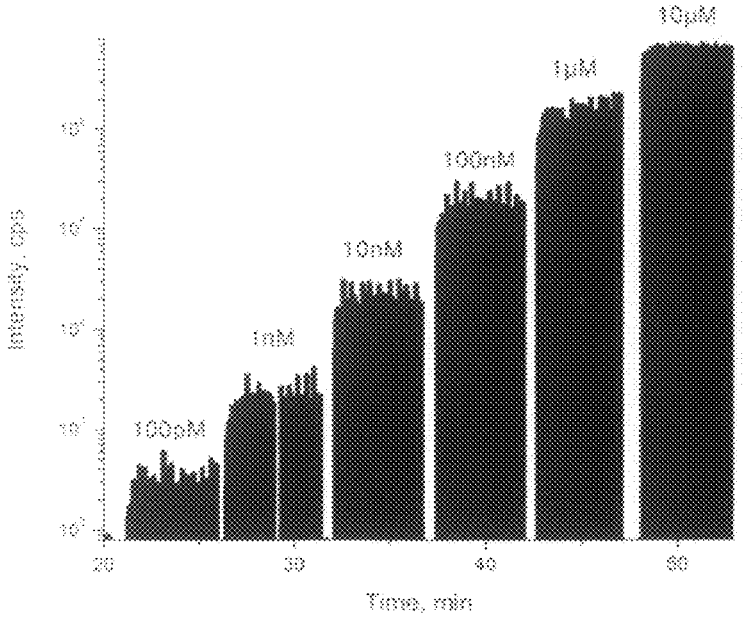
FIG. 10 depicts the linearity of the measurement with the μPESI chip. Verapamil was measured 60 times (injected amount 2.5 μl), ten times with each six different concentrations.
Figure 11:
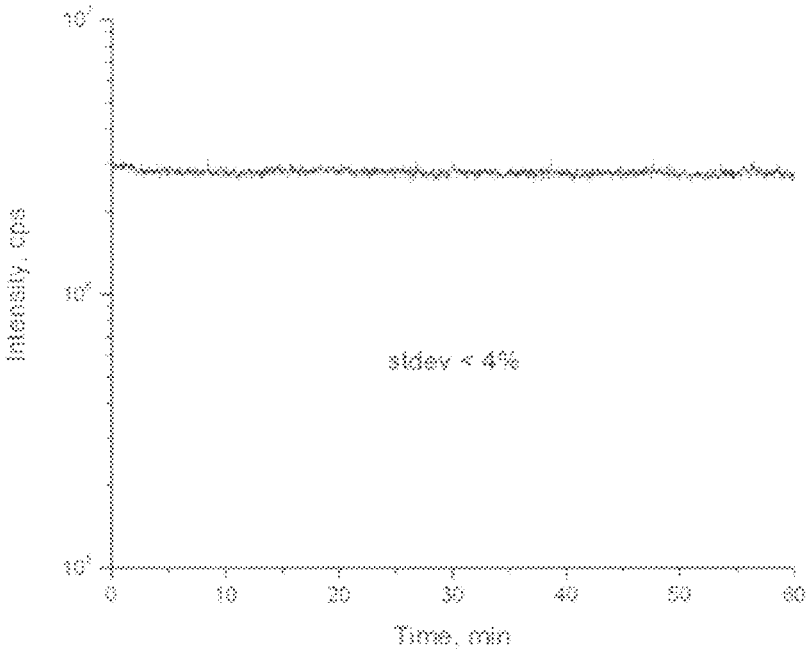
FIG. 11 illustrates the stability of the measurement using the μPESI chip. Measurement of 10 μM verapamil with MS/MS using SRM mode with continuous injection.

The μPESI chip offers high sensitivity and good stability. The limit of detection for verapamil measured with MS/MS using selected reaction monitoring (SRM) mode (m/z 455→m/z 165 and 303) was 30 μmol/l (75 amol) as seen in FIG. 9. The system shows also quantitative linearity ($r^2$=0.997) with linear dynamic range of at least 6 orders of magnitude (FIG. 10) and good stability (standard deviation<4%) at a measurement of 10 μM verapamil lasting for sixty minutes (FIG. 11).

The tests were extended to a variety of bioanalyses. The MSs used in these tests were a API300 triple-quadrupole, API3000 triple-quadrupole instruments (Applied Biosystems/AMDS Sciex, Concord, Canada), and a quadrupole-time-of-flight instrument Micromass Q-TOF Micro (Micromass/Waters, Manchester, UK). Nitrogen produced by a Whatman 75-720 nitrogen generator (Whatman Inc., Haverhill, Mass., USA) was used as curtain gas. A Microfluidic toolkit voltage supplier from Micralyne (Micralyne Inc., Edmonton, AB, Canada) was used.

Figure 12:
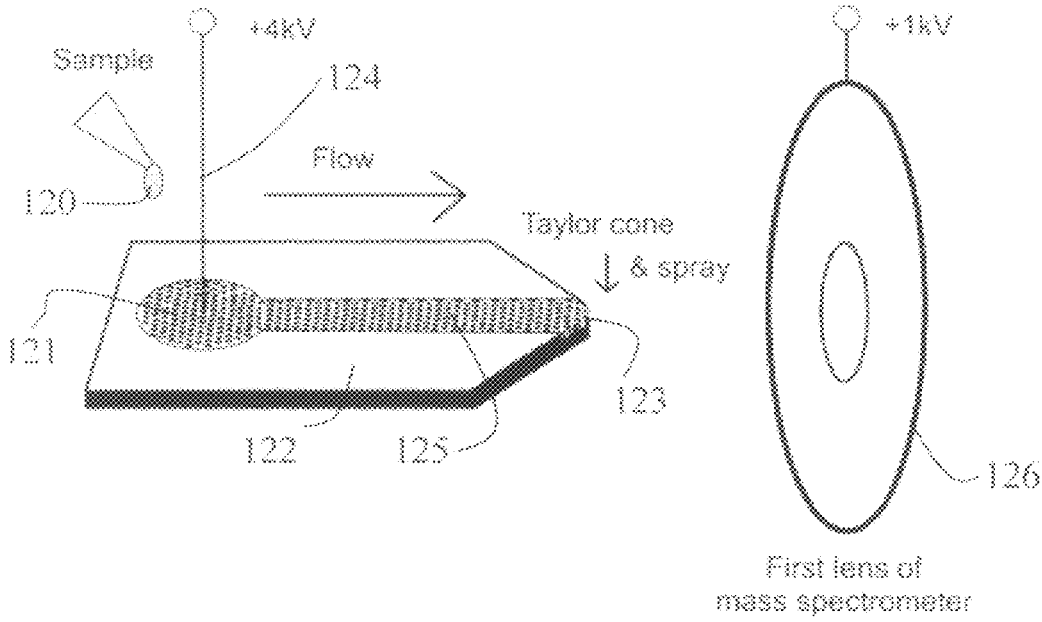
FIG. 12 shows the principle of combining the micropillar array with the mass spectrometer for ESI/MS measurements.

With reference to FIG. 12, the sample droplet 120 injected (0.5-4 μl) to the sample introduction spot 121 filled the chip 122 spontaneously by strong capillary forces to the ES tip 123. The high voltage (2-5 kV) required for the ES was applied to the sample introduction spot 121 by a platinum electrode 124. Since the entire chip 122 was conductive and the voltage drop across the micropillar array 125 was negligible, the 2-5 kV voltage provided sufficient electric field for stable ES. The electric current was measured between the high voltage supply and the platinum electrode by an amperometer (Meterman 38XR, Taiwan). In experiments, the distance between the tip and the first lens 126 of the mass spectrometer was about 1.5 cm.

For bioanalysis experiments verapamil, angiotensin I, angiotensin II, substance P, and horse heart myoglobin were used as test compounds and 2.5 μl of each sample was pipetted to the sample introduction spot. For the measurements of linearity and sensitivity verapamil was dissolved into acetonitrile:water (95:5) with 0.1% formic acid at concentrations of 10 pM to 10 μM. The metabolism sample was prepared by incubating R-enantiomer of sibutramine hydrochloride (purity>99%) with rat hepatocytes for 8 h. After sample preparation the sample was evaporated dryness and the residue was diluted to 50 μl of methanol. 10 μl of sample was dissolved into 500 μl acetonitrile:water (95:5) with 0.1% formic acid.

In the linearity and sensitivity measurements the selected reaction monitoring (SRM) mode in the positive mode was used to measure the verapamil signal and the selected reactions were m/z 455→m/z 165 and m/z 455→m/z 303. Quantitative linearity was measured by applying separately 10 times 2.5 μl of each concentration of verapamil sample. The average and relative standard deviation (RSD) for signal heights was calculated for each different concentration.

The peptides (angiotensin I, angiotensin II, and substance P) and the protein (horse heart myoglobin) were diluted into 80% aqueous methanol containing 1% acetic acid (two separate samples). The concentrations were 5 μM for the peptides and 300 nM for horse heart myoglobin. Full-scan mass spectra ranging from m/z 400 to 750 were measured from the peptide mixture and m/z 700 to 950 from the protein in the positive mode. Sibutramine metabolism sample was measured with Q-TOF Micro. A mass spectrum of solvent blank sample was subtracted from that of metabolism sample.

A solution of tetrabutylammoniumiodide (5 μM) in acetonitrile:water (95:5 v/v) with 0.1% formic acid was used to test the formation of ES plume at the tip of the chip. 2.5 μl of the solution deposited to an introduction spot and the formation of ESI was verified by videoing the tip of the chip with a CCD camera (Watec Camera WAT-502A, Japan).

In the measurement of long-term stability of the chip the verapamil solution was applied to the sample introduction spot via a fused silica capillary (i.d. 150 μm, o.d, 250 μm) using a syringe pump (Harvard Apparatus PDH2000, Harvard Apparatus, Holliston, Mass., USA) at a flow rate of 8 μl/min.

Performance

The performance of the μPESI chip was evaluated, concerning the self-filling and the formation of the ES ionization. The pillar array provides a liquid transfer by capillary action. It was noticed that the self-filling of the chip does not work when the pillar array is removed. Incomplete filling also hampers electrospray operation. The pillar channel structure is not prone to clogging, since the liquid can flow via several routes between the pillars. The flow rate at the tip of the ESI sprayer is dependent on the width of the channel and the flow rate in the channel is dependent on the diameter of the pillars and distance between the pillars. Best performance and stability was achieved by using 2.25-mm-wide channel, 15-50 μm-diameter pillars with the distances of 2-25 μm.

The ion current appears as soon as the liquid reaches the tip of the chip and fades away when the liquid runs out. The signal lasted for about 20 s (with a 2-μl sample) but by changing the dimensions of the chip and pillars the duration of signal can be decreased for faster analysis or increased for successive analysis with different MS scanning modes or for accumulation of the signal. The exact flow rate of solvents during the self-filling and electrospray could not be measured since the flow channel is open but the electric current, measured between the high voltage supply and the platinum electrode, varied between 20 and 150 nA, depending on the high voltage and solvents used, and the distance between the chip and MS. These values indicate that the spray from the tip is somewhere between normal ES and nanoES.

Figure 13A:
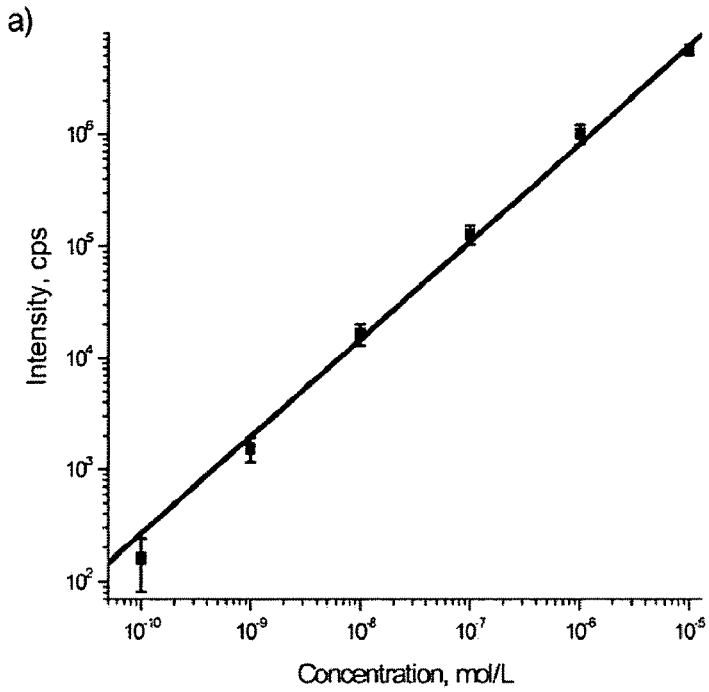
FIGS. 13A and 13B show the linearity of the signal of verapamil standards obtained with μPESI/MS/MS in SRM mode (reactions of m/z 455→m/z 165 and 303 were monitored) and the intensities of MS/MS signal of 10-nM and 100-nM verapamil solutions in 1-h continuous flow analysis, respectively.
Figure 13B:
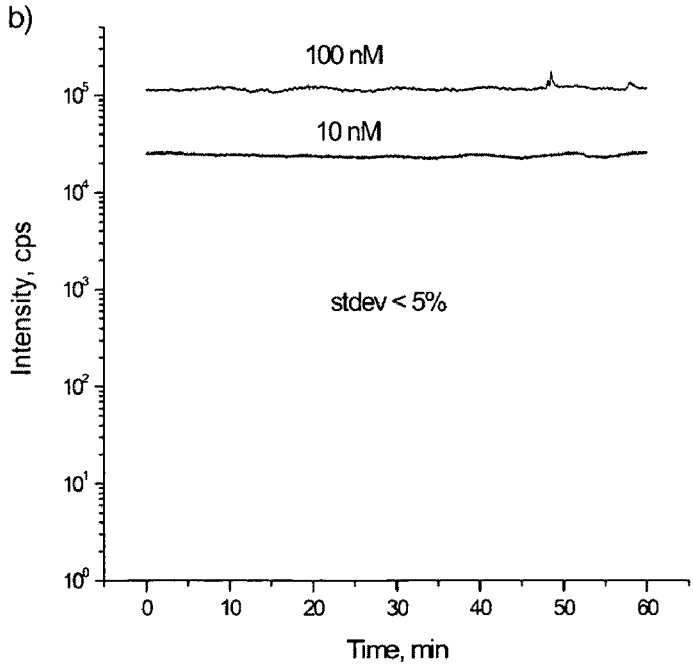

FIG. 13A shows the linearity of the signal of verapamil standards obtained with μPESI/MS/MS in SRM mode (reactions of m/z 455→m/z 165 and 303 were monitored). 2.5 μl of standard solutions at six different concentration levels were applied ten times each, and the average and standard deviation were calculated. FIG. 13B shows the intensities of MS/MS signal of 10-nM and 100-nM verapamil solutions in 1-h continuous flow analysis. The sample was infused continuously onto the sample introduction spot of the chip with a syringe pump at the flow rate of 8 μl/min.

Figure 14:
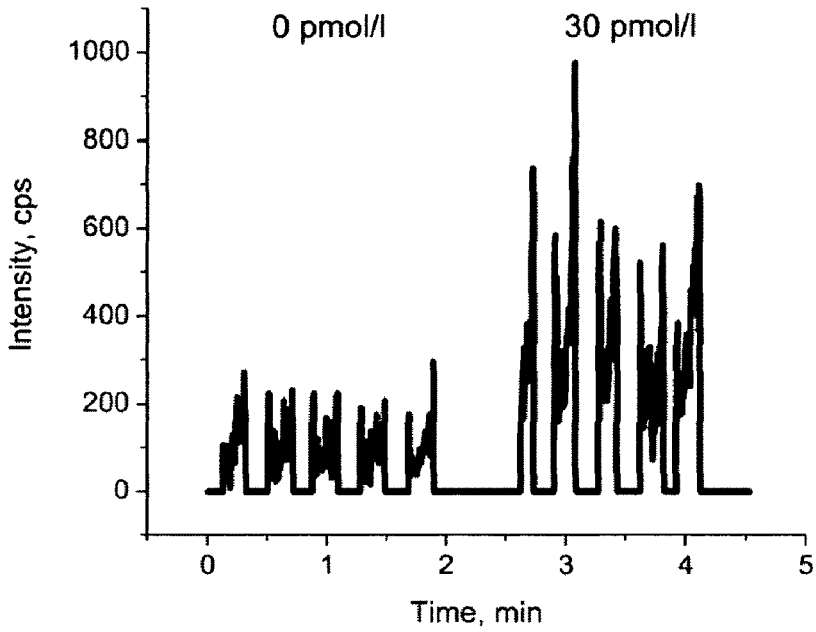
FIG. 14 show the intensity of MS/MS signal in SRM mode of 2.5-μl injection of five blank samples and five 30 μM verapamil samples (in acetonitrile:water (95:5) with 0.1% formic acid) to a μPESI chip.

FIG. 14 shows the detection capability of μPESI/MS/MS in SRM mode at a low concentration level, 30 pM, which was considered as a limit of detection. Similarly, the quantitative linearity of the system was tested with verapamil standard solutions in a concentration range of 100 pM to 10 μM with a 2.5-μl injection (ten times each concentration) and a correlation coefficient ($r^2$) of 0.997 was obtained, indicating good quantitative linearity of the system over a range of six orders of magnitude (FIG. 13A). The relative standard deviation (RSD), calculated from those ten injections, was less than 8% at each concentration level, except at 100 pM level in which the RSD was 30%. The stability of the signal with the microchip was tested by infusing 10 and 100 nM verapamil with a syringe pump at a flow rate of 8 μl/min for one hour (FIG. 13B). The signal measured with tandem mass spectrometry (MS/MS) was stable throughout the entire experiment, with a relative standard deviation of less than 5%, indicating suitability of μPESI/MS for long-term analysis.

Figure 15A:
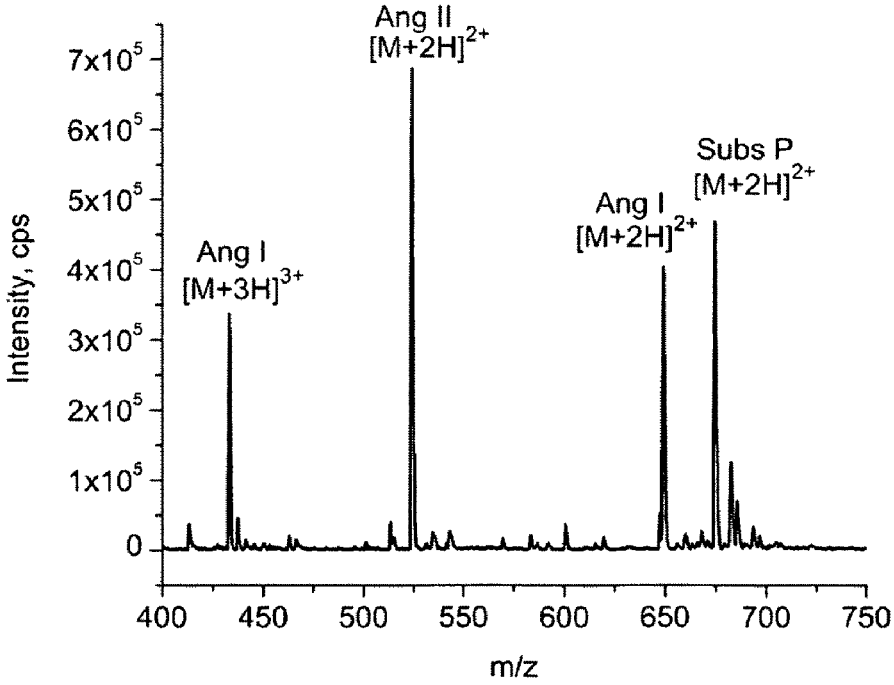
FIGS. 15A-15C illustrate a μPESI/MS mass spectra of a peptide mixture (angiotensin I and II, substance P), showing multiply charged ions at a concentration level of 5 μM, a protein (horse heart myoglobin, molecular weight 16 951), showing multiply charged ions at a concentration level of 300 nM, and sibutramine metabolites produced using rat hepatocytes, respectively.
Figure 15B:
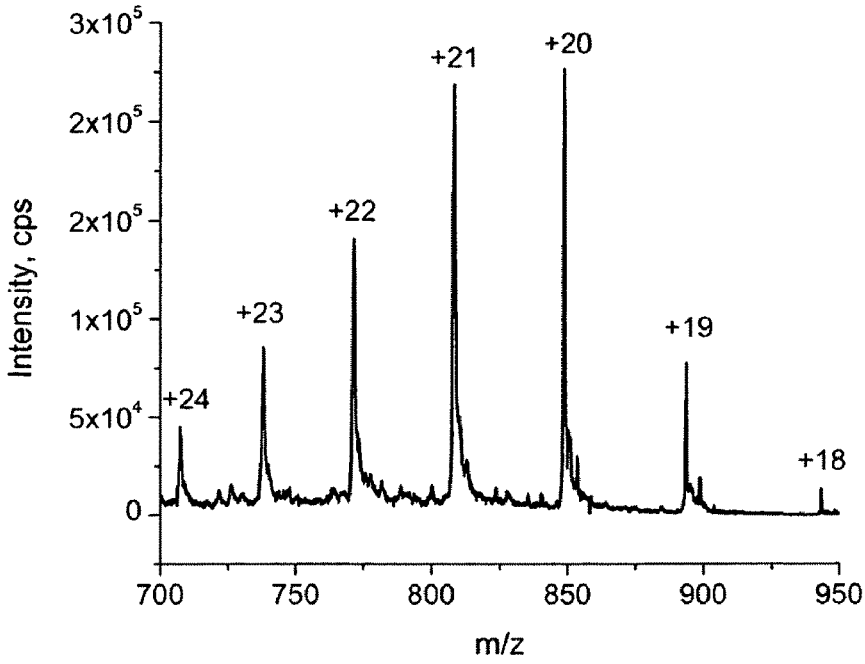
Figure 15C:
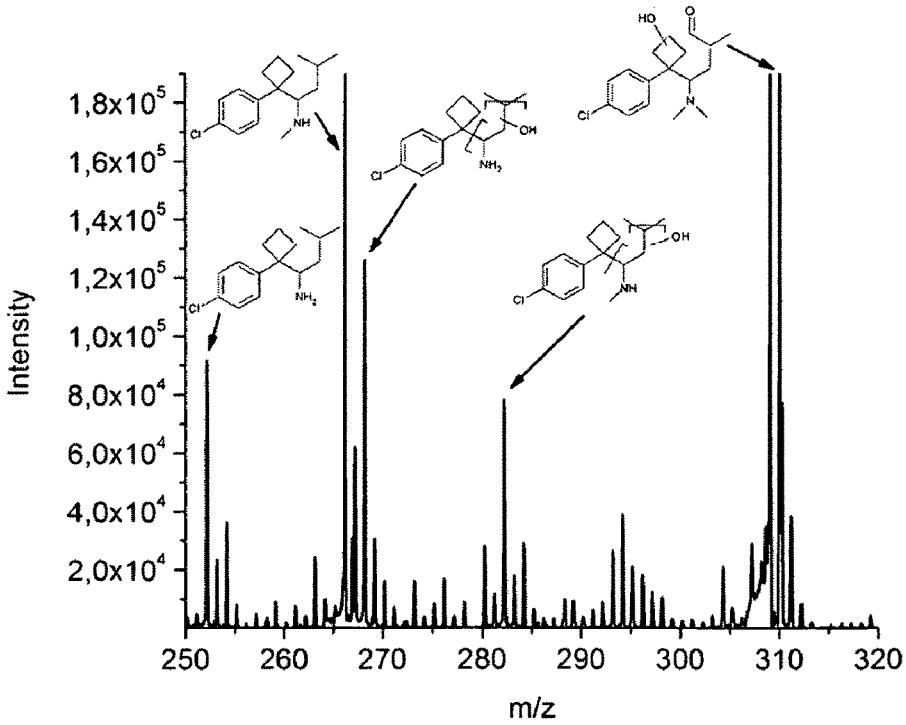

The μPESI/MS produced high-quality spectra for the biomolecules tested, showing multiply charged ions for three peptides (angiotensin I, angiotensin II, and substance P) and a protein (horse heart myoglobin) (FIGS. 15A-15C). The usability of μPESI chip was also tested with real metabolic sample of sibutramine. A 2.5-μl injection of the metabolism sample showed demethylated (at m/z 252, 266, 268, and 282), hydroxylated (at m/z 268 and 310) and dehydrogenated (at m/z 310) sibutramine metabolites. Also small amounts of sibutramine glucuronides were found (at m/z 444 and 458, not shown in FIG. 15C). The same metabolites were found also with liquid chromatography-ESI-MS/MS.[24]

μPESI-MS was shown to be a sensitive technique as the limit of detection measured for verapamil (FIG. 14) using the selected reaction monitoring (SRM, m/z 455→m/z 165 and 303) mode was 60 amol (28 fg) with a 2.5-μl injection volume (corresponding to 30 pmol/l or 13.5 pg/ml). Comparison of the detection limits determined with μPESI/MS and nanospray/MS showed that the sensitivity was typically better or at least similar to that obtained with nanospray/MS or microfluidic HPLC-chip/MS.

The chemicals and samples used in the experiments presented above were obtained mainly from commercial sources. Acetonitrile was obtained from Rathburn (Walkerburn, Scotland). Acetone was obtained from VWR International AB (Stockholm, Sweden). Methanol was obtained from J. T. Baker, Deventer, Holland and ethanol was from Altia, Rajamaki, Finland. Formic acid and acetic acid was obtained from Sigma-Aldrich, St. Louis, Mo., USA. All solvents were of HPLC grade. Water was purified with Milli-Q water purification system (Millipore, Molsheim, France). Verapamil was purchased from ICN Biomedicals Inc. (Aurora, Ohio, USA) and tetrabutylammoniumiodide from Lancaster Synthesis, (Eastgate, White Lund, Morecambe, England). The peptides (angiotensin I, angiotensin II, and substance P) and horse heart myoglobin were purchased from Sigma-Aldrich. R-enantiomer of sibutramine hydrochloride (purity>99%) was obtained from Research Institute for Pharmacy and Biochemistry (Prague, Czech Republic).

The invention claimed is:

1. An electrospray ionization device for forming a stream of ionized sample molecules, comprising:

a sample introduction zone for receiving a liquid-form sample;

a tip for spraying the liquid-form sample into aerosol or gaseous form; and a flow channel connecting the sample introduction zone and the tip, the flow channel comprising an array of transversely oriented first microstructures adapted to passively transport the liquid-form sample introduced in the sample introduction zone to the tip by means of capillary forces, wherein the sample introduction zone and the flow channel are open from a side from which sample is introduced.

2. The device according to claim 1, wherein said first microstructures are micropillars protruding from a bottom surface of the flow channel.

3. The device according to claim 2, wherein said micropillars comprise substantially circular or elliptical cross-sections.

4. The device according to claim 1, wherein the first microstructures are arranged in rows shifted in one dimension in turns.

5. The device according to claim 1, wherein a cross-sectional diameter of at least one of the microstructures is 1-80 μm and a center-to-center distance between neighboring microstructures is 1-80 μm.

6. The device according to claim 1, wherein the flow channel is a depression in a substrate, the depth of the depression being 1-80 μm.

7. The device according to claim 6, wherein the flow channel in a vicinity of the tip tapers towards the tip as the depression approaches the tip.

8. The device according to claim 1, wherein the electrospray ionization device is fabricated on a glass, polymer, or silicon wafer.

9. The device according to claim 1, wherein the sample introduction zone comprises an array of second microstructures.

10. The device according to claim 1, wherein the sample introduction zone, the flow channel, and the tip lie on the same plane, the liquid-form sample is passively transported in a lateral direction along the same plane.

11. The device according to claim 1, wherein the sample introduction zone, the tip and the flow channel are in the form of a depression in a planar substrate, and the liquid-form sample is passively transported by the capillary forces in a plane parallel to the planar substrate.

12. The device according to claim 1, wherein a surface of the flow channel is provided with functional coating material selected from at least one of: hydrophilic coating material, hydrophobic, and non-polar coating material, the non-polar coating material comprising at least one of C18, C8, silica, and NH2.

13. The device according to claim 1, wherein a surface of the flow channel exhibits a contact angle for de-ionized water in a range of 1-45°.

14. The device according to claim 1, wherein at least one of the sample introduction zone and the flow channel comprises immobilized enzymes, microsomes, or other biological material.

15. A method for performing a mass spectrometric analysis, comprising:

vaporizing a solution comprising a sample using an electrospray ionization device of claim 1;

ionizing the vaporized solution to form gas phase ions using an electrospray ionization device of claim 1;

separating the gas phase ions based on respective masses and charges of the gas phase ions; and directing the separated gas phase ions to a detector.

16. The electrospray ionization device of claim 13, wherein the flow channel exhibits a contact angle for de-ionized water in the range of 10-35°.

17. The electrospray ionization device of claim 13, wherein the flow channel passively transports the liquid-form sample from the sample introduction zone to the tip without using voltage from a voltage source.

* * * * *